US007388554B2

(12) United States Patent
Askildsen et al.

(10) Patent No.: US 7,388,554 B2
(45) Date of Patent: Jun. 17, 2008

(54) MACHINE PRODUCIBLE DIRECTIVE CLOSED-LOOP IMPULSE ANTENNA

(76) Inventors: Bernt Askild Askildsen, 1507 Plateau La., Rapid City, SD (US) 57703; Scott Randall Thompson, HC 89 Box 69, Hermosa, SD (US) 57744

( * ) Notice: Subject to any disclaimer, the term of this patent is extended or adjusted under 35 U.S.C. 154(b) by 0 days.

(21) Appl. No.: 10/908,907

(22) Filed: May 31, 2005

(65) Prior Publication Data

US 2006/0267855 A1 Nov. 30, 2006

(51) Int. Cl.
*H01Q 9/16* (2006.01)
*H01Q 9/38* (2006.01)
*H01Q 9/28* (2006.01)

(52) U.S. Cl. ..... 343/793; 830/807

(58) Field of Classification Search ..... 343/793, 343/807, 845, 830
See application file for complete search history.

(56) References Cited

U.S. PATENT DOCUMENTS

| | | | | |
|---|---|---|---|---|
| 3,369,245 A | 2/1968 | Rea | 343/795 |
| 3,984,838 A | 10/1976 | Voronoff | 343/739 |
| 4,125,840 A | 11/1978 | Cassel | 343/807 |
| 4,376,940 A | 3/1983 | Miedema | 343/840 |
| 4,642,645 A | 2/1987 | Haupt | 342/379 |
| 4,679,007 A | 7/1987 | Reese et al. | 343/17.3 |
| 4,758,843 A | 7/1988 | Agrawal et al. | 343/814 |
| 4,803,495 A | 2/1989 | Monser et al. | 343/777 |
| 5,134,423 A | 7/1992 | Haupt | 343/912 |
| 5,184,143 A | 2/1993 | Marko | 343/845 |
| 5,644,321 A | 7/1997 | Benham | 343/826 |
| 5,734,355 A * | 3/1998 | Watanabe | 343/859 |
| 6,025,811 A | 2/2000 | Canora et al. | 343/793 |
| 6,323,821 B1 | 11/2001 | McLean | 343/795 |
| 6,469,590 B1 * | 10/2002 | Lewis et al. | 333/17.3 |
| 6,774,858 B1 | 8/2004 | Wiesenfarth | 343/845 |

* cited by examiner

*Primary Examiner*—Shih-Chao Chen
(74) *Attorney, Agent, or Firm*—Scott R. Thompson

(57) ABSTRACT

A low-cost high performance ultra wideband antenna that combines a plurality of shielded cables with properly selected and carefully positioned load balancing components to form a novel closed loop dipole is disclosed. The apparatus includes a closed-loop broadband antenna circuit that may be comprised of single or multiple conductive radiating elements that are electrically connected to one another at the flare-end of each antenna leaf by at least one shielded conductor in one or more shielded cables of any type. The shielded cable portion of the closed loop circuit may be interrupted by load impedance tapered regions that are positioned in an area that does not interfere or interferes minimally with antenna performance. The closed-loop broadband antenna circuit and the feed-point connections may be grounded by a separate path within the device. The disclosed approach simultaneously mitigates known problems of parasitic side lobes, antenna ringing, and RF coupling that commonly plague prior art.

5 Claims, 4 Drawing Sheets

MACHINE PRODUCIBLE DIRECTIVE CLOSED-LOOP IMPULSE ANTENNA

CROSS-REFERENCE TO RELATED APPLICATIONS

Current US Class: 343/793, 343/807, 343/845 International Class: H01Q 001/38, 48 Field of Search: 250/216, 342/379, 343/727, 730, 739, 740, 775, 777, 793, 795, 807, 813, 814, 815, 819, 820, 826, 828, 841, 845, 912, 913

OTHER PUBLICATIONS

[1] R. L. Carrel, "The characteristic impedance of two infinite cones of arbitrary cross section," IEEE Trans. Antennas Propagation, vol. AP-6, no. 2, pp. 197-201, 1958.

[2] T. T. Wu and R. W. P. King, "The Cylindrical Antenna with Nonreflecting Resistive Loading", IEEE Transactions on Antennas and Propagation, vol. AP-13, No. 3, pp. 369-373, May 1965.

[3] Shen, "An Experimental Study of the Antenna with Nonreflecting Resistive Loading", IEEE Transactions on Antennas and Propagation, vol. AP15, No. 5, September. 1967, pp. 606-611.

[4] Clapp, "A Resistively Loaded, Printed Circuit, Electrically Short Dipole Element for Wideband Array Applications", IEEE, May 1993, pp. 478-481

[5] K. L. Shlager, G. S. Smith and J. G. Maloney, "Optimization of bow-tie antennas for pulse radiation," IEEE Trans. Antennas Propagation, vol. 42, no. 7, pp. 975-982, 1994.

[6] Amert, T., Wolf, J., Albers, L., Palecek, D., Thompson, S., Askildsen, B., Whites, K. W., "Economical Resistive Tapering of Bowtie Antennas," IEEE Antennas and Propagation Society Symposium, ISIU RSM, Monterey, Calif., Page(s): 1772-1775, Jun. 20-25, 2004

[7] Johnson, R. C., "Shielded-Loop Antenna", Antenna Engineering Handbook, Third Edition, McGraw-Hill, ISBN 0-07-032381-X, p. 5-19, 1993

STATEMENT REGARDING FEDERALLY SPONSORED RESEARCH OR DEVELOPMENT

[8] K. S. Yngvesson, D. H. Schaubert, T. L. Korrzeniowski, E. L. Kollberg, T. Thungren, and J. Johansson, "End-fire tapered slot antennas on dielectric substrate," IEEE Trans. Antennas Propagat., vol. AP-33, pp. 1392-1400, Dec. 1985.

REFERENCE TO SEQUENCE LISTING, A TABLE, OR A COMPUTER PROGRAM APPENDIX

[9] A. A. Lestari, A. G. Yarovoy, L. P. Ligthart, "Capacitively-Tapered Bowtie Antenna," International Research Centre for Telecommunications-Transmission and Radar, Delft University of Technology-Faculty of Information Technology and Systems, Mekelweg 4, 2628 CD, Delft, The Netherlands.

[10] A. G. Yarovoy, L. P. Ligthart, "Ultra-Wideband Antennas for Ground Penetrating Radar," International Research Centre for Telecommunications-transmission and Radar, Faculty of Information Technology and Systems, TU Delft, Mekelweg 4, 2628 CD Delft, The Netherlands.

[11] Schantz, G. H., "A Brief History of UWB Antennas," The Proceedings of the IEEE UWBST Conference, 2003.

BACKGROUND OF THE INVENTION

The challenge of specifying an optimal antenna geometry that supports a broad range of wavelengths is generally afforded at the expense of antenna ringing, polarization offsets, parasitic side-lobe generation, radiation efficiency or any combination thereof. End-fire or flare-end ringing occurs when a signal bounces back-and-forth between the feed-point and the flare end of an antenna. This is a particularly prominent problem for ultra-wideband antennas such as that described in U.S. Pat. Nos. 3,369,245 and 3,984,838 and by Carrel in [1].

A primary challenge of antenna design is to mitigate the forgoing problems without distorting the rising edge of the transmitted pulse or destabilizing the ultra wideband impedance characteristics of the antenna. Prior art employed combinations of flair end lump loading and impedance tapering to suppress end-fire ringing at the cost of rising edge distortion and poor radiation efficiency; see [2], and U.S. Pat. No. 4,679,007.

The quest for broadband antennas that are capable of effectively transmitting impulse signals or multiple carrier waves has been ongoing for nearly a half-century and is documented through prior art and public disclosure including the dipole antenna, U.S. Pat. No. 4,125,840; resistive loaded and tapered antennas, [3] and U.S. Pat. Nos. 4,642,645 and 4,803,495; printed circuit board antennas, [4] and U.S. Pat. No. 4,758,843; side-lobe suppression antennas, U.S. Pat. No. 4,376,940; and lump loading for maximal energy transfer, U.S. Pat. No. 4,679,007.

Lump loading alone does not mitigate the problem of end-fire ringing during the first several cycles and consequently target detection applications are impeded at close range. Tapered antennas address the problem of close range target detection very effectively by distributing bands of impedance across the antenna to convert the ringing energy into heat. However, this payoff is afforded at the expense of a substantial drop in radiation efficiency and an accompanying requirement for more powerful transmitter hardware. Moreover, the discrete interface at each tapered band creates parasitic side-lobes and induces reflections near the feed point that distorts the rising edge of the transmitted pulse. This is a particularly prominent problem for target identification systems because the rising edge of the pulse is used to induce reflections that carry sufficient spectral bandwidth to characterize the target. These reflections are only useful if the transmitted signal has very low levels of distortion.

More recent work by Shlager, Smith and Maloney partially addressed the problem by applying a resistive taper to bowtie antennas [5]. The devices were implemented by constructing bow-tie antenna leaves from three sections of material that were comprised of varying conductivities that followed the tapering guidelines in [2]. A continued effort by Askildsen, Thompson, Whites, et al. in 2004 expanded the applicability of resistive tapering for high-performance ultra wide band bow-tie antennas in [4]. These efforts further revealed that resistive tapering reduces the return signal of an ultra wideband (UWB) signal pulse.

Several recent designs were patented to address the deficiencies of the above listed prior art including a low side-lobe resistive reflector antenna, U.S. Pat. No. 5,134,423; a low profile antenna, U.S. Pat. No. 5,184,143; a top loaded Bow-Tie antenna, U.S. Pat. No. 6,323,821; a closely coupled directive antenna, U.S. Pat. No. 6,025,811; a tapered, folded monopole antenna, U.S. Pat. No. 6,774,858. Each of these prior disclosures employed unique methods to mitigate known problems of the expired patents that were described earlier, yet none fully and simultaneously address the problems of end-fire ringing, consistent impedance characteristics, the rising edge distortion on the transmitted pulse, parasitic side lobe generation, non-uniform polarization artifacts, radiation efficiency, or any combination thereof.

While prior art does substantially improve select antenna parameters, these methods introduce new design tradeoffs that interfere with antenna performance. This invention applies a novel approach that leverages on the principles of shielded closed loop antennas [7], ultra wide band antenna design techniques, and impedance tapering to devise an impulse antenna that mitigates the foregoing. The invention simultaneously provides efficient canceling for balanced oppositely polarized signals and safe dissipation for unbalanced signal energy.

BRIEF SUMMARY OF THE INVENTION

This invention discloses a novel design that effectively uses conductive antenna elements and one or more matched coax cables behind the reflector back-shield to extract the performance of a slot antenna from an ultra-wideband antenna. The disclosed design also places any form of resistive loading on the outside of the back reflector shield to simultaneously mitigate antenna ringing and parasitic side-lobe generation without sacrificing radiation efficiency. The complete assembly emulates a shielded loop antenna that is typically used for continuous wave emissions; however the device is comprised of geometries that support high performance ultra-wideband dipole transmission.

BRIEF DESCRIPTION OF SEVERAL VIEWS OF THE DRAWINGS

Electric equivalent circuits of the disclosed invention are illustrated in FIGS. 1 and 3. The disclosed invention is graphically depicted in the form of a bow-tie antenna in FIGS. 3 through 12 to illustrate the invention. However, these figures are not intended to restrict the scope of this invention to bow-tie antennas.

DETAILED DESCRIPTION OF THE INVENTION

Broadband antennae are commonly energized by two matched signal generators to simultaneously couple oppositely polarized impulse signals onto the feed-points of an antenna as illustrated at 1 and 2 in FIGS. 1 through 5. Impedance mismatches at these feed point interfaces, which are typically small, and at the flare-end interfaces that are illustrated at 6 in FIGS. 2, 4, 5 and 6, which are typically large, induce reflections that rapidly deteriorate antenna performance. This is a particularly prominent problem with broadband antennas because it is difficult to design impedance interfaces that are consistent over a wide spectrum.

Figure 1:
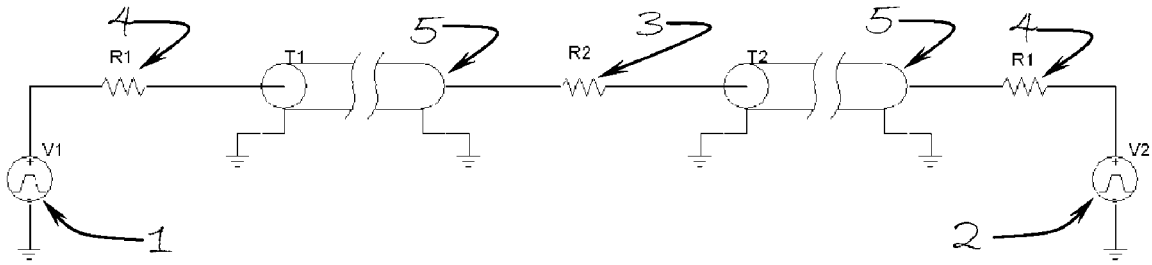
FIG. 1: Is an equivalent circuit for ungrounded cancellation.
Figure 2:
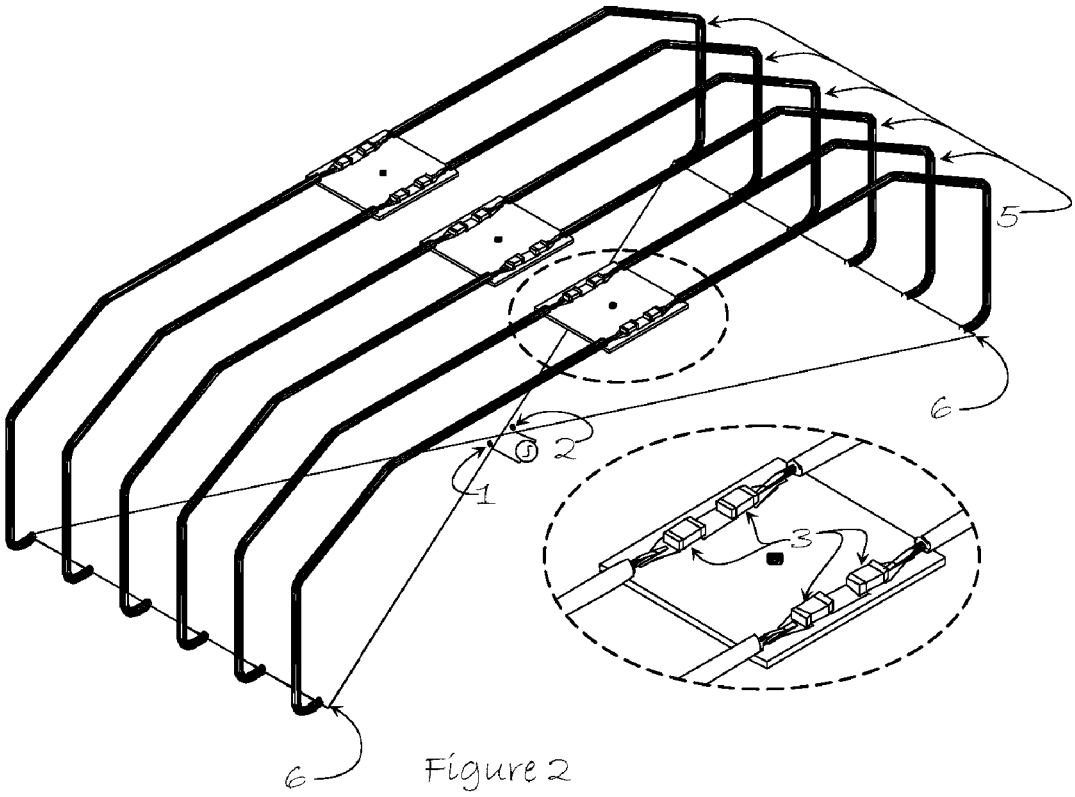
FIG. 2: Is an impedance loaded antenna circuit for ungrounded cancellation.
Figure 3:
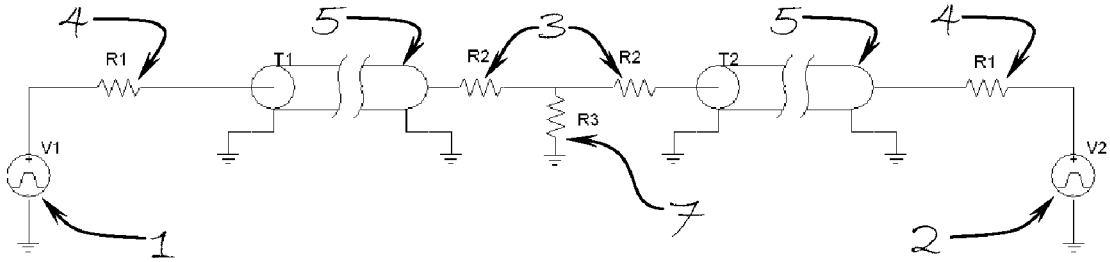
FIG. 3: Is an equivalent circuit for grounded cancellation.
Figure 4:
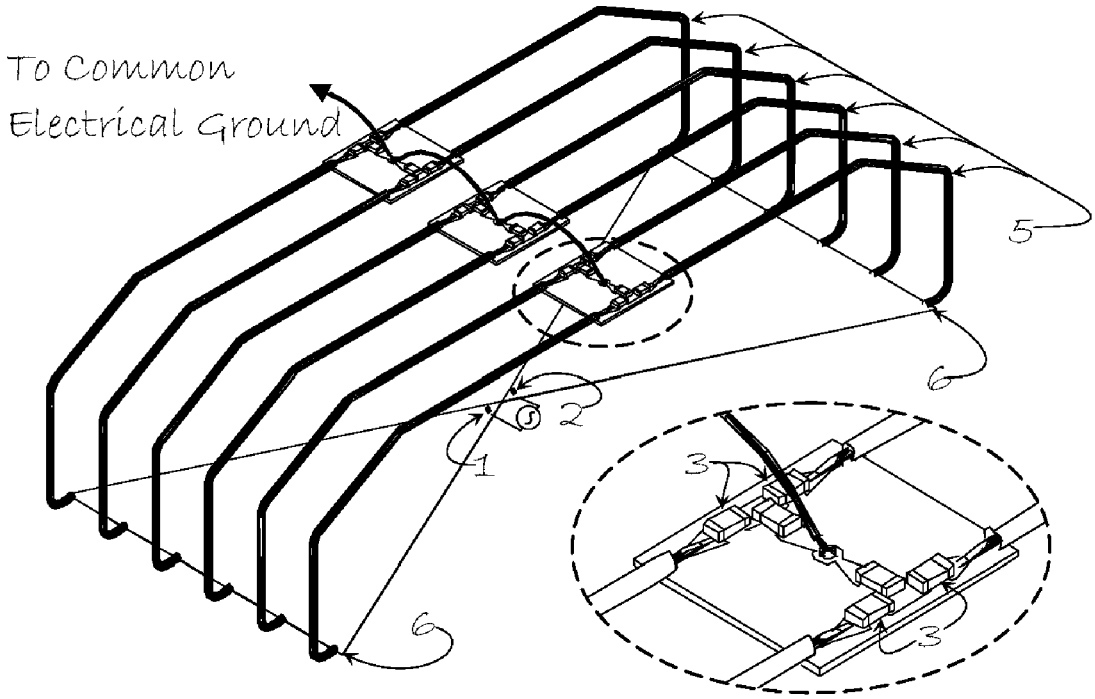
FIG. 4: Is an impedance loaded antenna circuit for grounded cancellation.
Figure 5:
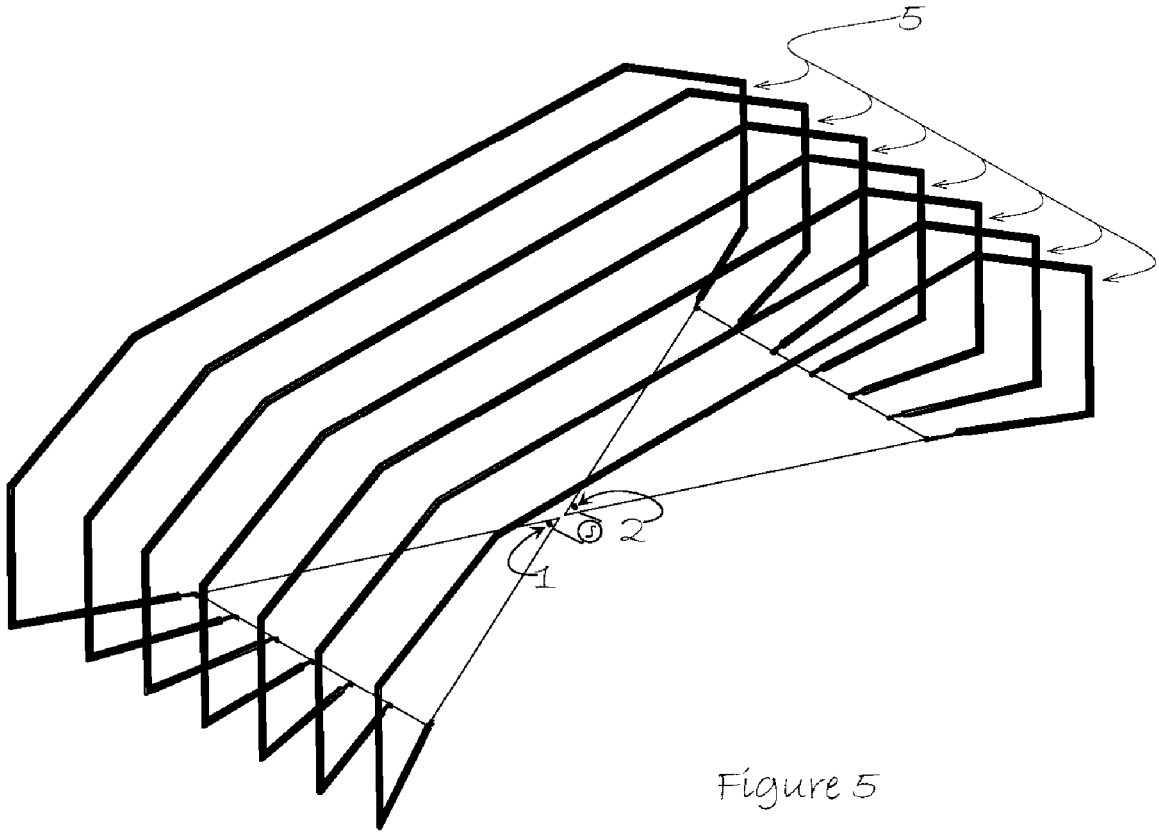
FIG. 5: Is a coax closed-loop antenna circuit without impedance loading.
Figure 6:
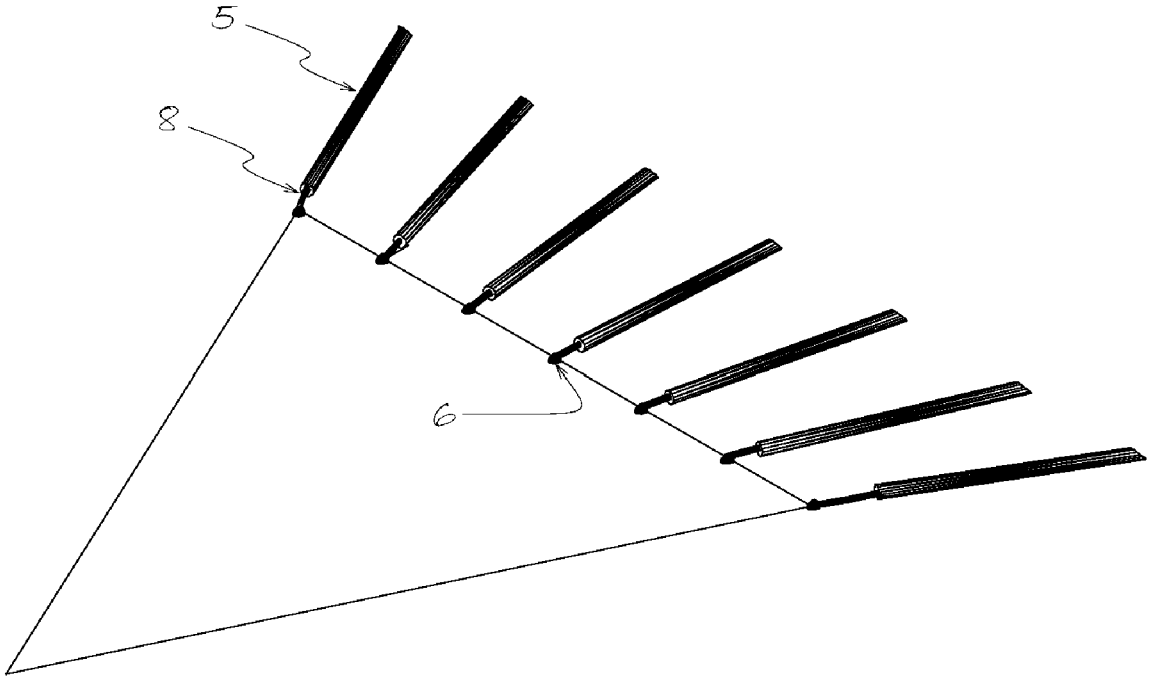
FIG. 6: Is how several shielded cables are connected to an antenna leaf.

The disclosed invention uses broadband shielded cables to smoothly guide the transmitted energy away from the antenna flare end. The matched coax cables direct this energy to an assembly of impedance loads like those shown at 3 in FIGS. 1 thru 4 that facilitate energy cancellation between the oppositely polarized impulses. In an alternative embodiment of the disclosed invention like that shown in FIG. 6, the intrinsic impedance of the coax cables may be used to absorb this energy. The signal generators shown in FIGS. 1 and 2 represent the individual transmitters that supply energy to the feed point of each antenna leaf. The serial impedances R1 at 4 in FIGS. 1 and 3 represent the intrinsic impedance of each antenna leaf and are not intended to represent a specific or stand-alone component of this invention. The antenna leafs are connected in a closed circuit using shielded cables 5 that are terminated at a matched impedance R2 as illustrated at 4 in FIGS. 1 thru 5.

The antenna elements of the disclosed invention are energized by oppositely polarized pulses at 1 and 2, just like any common broadband dipole antenna. Monopole embodiments of this invention are implicitly encompassed by the spirit of this invention. These signals travel across the antenna leaves 3 and through one or more shielded coax cables 5 to dissipation impedance loads 3 where the energy is cancelled and converted to heat. A less optimal embodiment of this invention may place similar impedance tapers elsewhere on the closed-loop antenna circuit such as on the antenna leaves. An additional path to ground, which uses an impedance load at 7, provides a supplementary path to convert any remaining energy into heat. The purpose of this impedance is to dissipate any surplus energy if the generated pulses are not perfectly balanced.

Construction of the disclosed invention is graphically illustrated in FIGS. 2 and 5 thru 8. One or more center conductors like those shown at 8 in FIG. 6 of one or more conventional impedance matched coax cables or other shielded cables are connected directly to the flare-end of the antenna at 6 in these figures; an enlarged illustration of this connection is shown at 6 in FIG. 6.

Figure 7:
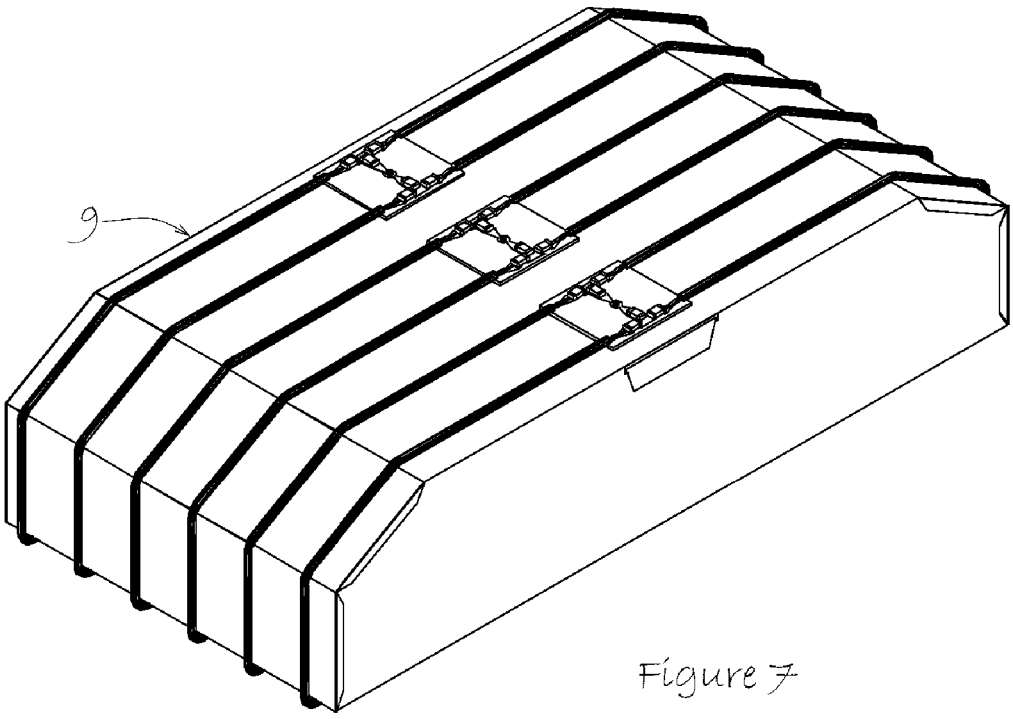
FIG. 7: Is a shielded closed-loop antenna circuit with impedance loading.
Figure 8:
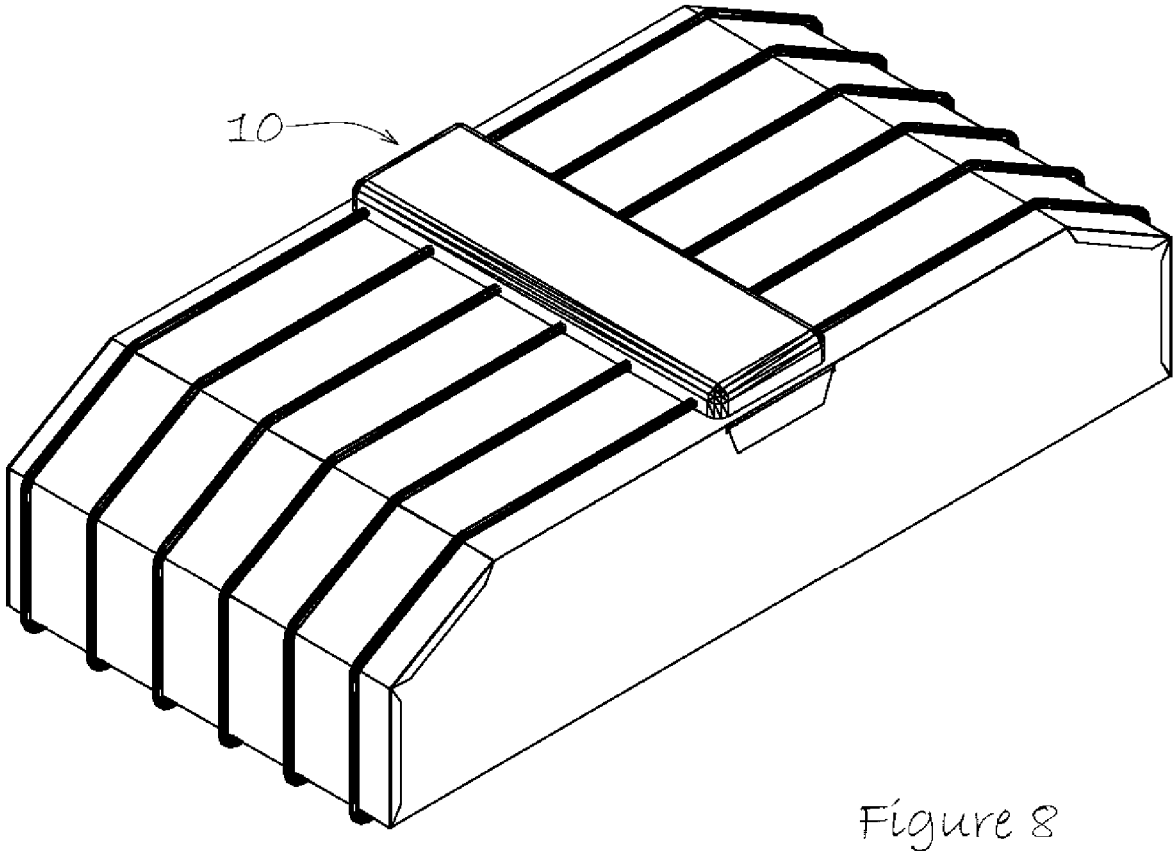
FIG. 8: Is a shielded closed-loop antenna circuit with shielded electronics.

A grounded back reflector shield may be placed behind the antenna element to suppress unintentional radiation and to improve antenna directivity. In this embodiment the outer shield of each cable is connected to the antenna back-shield 9, also commonly known as the reflector, as shown in FIGS. 7 and 8. If a back reflector shield is not used, the outer shield of each cable should be electrically connected to common ground. If a given antenna is used to radiate in more than one direction or if a back-shield is not used for any other reason, the coax cables can be placed along the side of the antenna and in plane that exhibits the least amount of radiation instead of being placed along the back reflector shield. One intention of this invention is to electrically isolate the reflector back-shield from the antenna leaves to prevent side and rear lobe formation; accordingly there are no recommended fully conductive paths between the center conductive elements in the coax cables and common electrical ground or to any conductive material that is on the outside of the reflector shield. Physical placement of the shielded cables is illustrated in FIGS. 2 and 4 thru 7. Though it is not required, optimal placement of all of the shielded cables is on the outside of the back-shield. A less optimal embodiment of this invention may line the inside of the back reflector shield with the shielded cables so that they are physically placed between the reflector back shield and the antenna leaves. The energy dissipating circuits should be shielded as shown at 10 in FIG. 8 to prevent unintentional radiation.

The application of thin side shields to increase antenna directivity shown in these figures is intended to show an optimal configuration of the antenna. The side shields shown in the drawings are not intended to restrict the scope of this invention to only those antenna apparatuses with side shields. Conductive tape or soldered thin conductive foil may be affixed to the inside of the side reflectors around the antenna boundaries to prevent RF leakage; however, the addition of the same or the previously noted side shield walls are not a required component of this invention. A optional protective non-conductive coating may be applied to the outer conductive layer to strengthen the antenna apparatus.

Fully assembled embodiments of the disclosed invention are shown by example with trapezoidal reflector shield and cable profiles in FIGS. 2, 4, 5, 7 and 8. The completed assemblies shown therein comprise in part several important and functional components; namely the antenna leaves, one or more coax cables to direct RF signals to the energy dissipating circuits, optional reflector back and side shields, and the RF dissipation impedance circuits. The antenna circuit disclosed herein may comprise any shape, impedance, wave altering patterns, surface mount components, or any combination thereof.

It is possible to embody this invention in specific antenna forms and specific smooth or jagged back-shield geometries or profiles other than those described herein without departing from the spirit of the invention. Accordingly, the embodiments described in this disclosure and in the drawings are merely illustrative and should not be considered restrictive in any way. The scope of this invention is determined by the claims of this application rather than any restricting examples that comprise the preceding description. All variations and equivalents that fall within the scope of any of these claims are intended to be embraced therein.

What is claimed is:

1. An antenna apparatus that combines a broadband antenna and a plurality of shielded cables to transport unspent electromagnetic energy away from an intentional radiating element in said antenna to a plurality of electronic components for the purpose of dissipating said unspent electromagnetic energy at a location that does not interfere with or interferes minimally with antenna performance and that comprises in combination:

a. a plurality of RF broadband radiating elements, b. a means to electrically connect a plurality of shielded cables between a plurality of said RF radiating elements, c. a means to electrically connect a plurality of shielded cables between said RF radiating elements and a plurality of electronic components that are used to absorb unspent RF energy, d. a means to electrically connect a plurality of shielded cables between a plurality of said RF radiating elements and a plurality of electronic components that are used to impedance balance the antenna, e. a means to electrically connect a plurality of shielded cables between a plurality of said RF radiating elements and common electrical ground, f. a means to electrically connect a plurality of shielded cables between a plurality of said RF radiating elements and a plurality of materials that are used to reflect electromagnetic energy, g. a means to affix a plurality of materials that are used to prevent RF leakage throughout said antenna apparatus.

2. The antenna apparatus in claim 1, a means to connect a plurality of shielded cables to the antenna to form a reflector back-shield.

3. The antenna apparatus in claim 1, a means to connect a plurality of shielded cables to the antenna to redirect unspent energy from said RF radiating elements to a plurality of electronic components that are physically located elsewhere on the antenna apparatus so that said unspent energy interferes minimally with intentional signals on said antenna.

4. An antenna apparatus in claim 1 that comprises in combination:

a. a means to affix a plurality of conductive materials to a plurality of sides on said antenna apparatus, b. a means to affix a plurality of impedance tapered materials to a plurality of sides on said antenna apparatus, c. a means to affix a plurality of impedance tapered reflector shields to said antenna apparatus, d. a means to affix a plurality of fully conductive reflector shields to said antenna apparatus, e. a means to electrically connect a plurality of impedance cancellation networks to said antenna apparatus.

5. An antenna apparatus in claim 1 that comprises in combination:

a. a means to affix a non-conductive protective coating to said antenna, b. a means to affix non-conductive materials to strengthen the physical structure of said antenna.

* * * * *